US005353529A

United States Patent [19]

McCullough

[11] Patent Number: 5,353,529

[45] Date of Patent: Oct. 11, 1994

[54] APPARATUS FOR BACKFILLING

[76] Inventor: Charles E. McCullough, 1112 Quail Run, Burk Burnett, Tex. 76354

[21] Appl. No.: 113,975

[22] Filed: Aug. 30, 1993

Related U.S. Application Data

[63] Continuation-in-part of Ser. No. 813,209, Dec. 23, 1991, abandoned.

[51] Int. Cl.[5] ..... E02F 5/22

[52] U.S. Cl. ..... 37/142.5; 405/179; 172/43

[58] Field of Search ..... 37/142.5, 350, 351, 37/329, 213, 244, 254, 257, 253; 172/76, 43, 351, 360, 518, 63, 184; 405/179

[56] References Cited

U.S. PATENT DOCUMENTS

| | | |
|---|---|---|
| 1,437,594 | 12/1922 | Kelly . |
| 2,714,775 | 8/1955 | Crawford . |
| 2,966,218 | 12/1960 | Johnson . |
| 3,305,949 | 2/1967 | Holley . |
| 3,314,174 | 4/1967 | Haggard . |
| 3,477,514 | 11/1969 | Woitas . |
| 3,503,450 | 3/1970 | Day . |
| 3,792,734 | 2/1974 | Ellis et al. . |
| 3,903,624 | 9/1975 | Holl . |
| 3,905,137 | 9/1975 | Gee . |
| 3,934,363 | 1/1976 | McMurray . |
| 4,059,911 | 11/1977 | Bean et al. . |
| 4,283,867 | 8/1981 | Brown . |
| 4,336,760 | 6/1982 | Cohen et al. . |
| 4,457,086 | 7/1984 | Bacon . |
| 4,756,101 | 7/1988 | Friberg et al. . |
| 4,808,305 | 2/1989 | Miller . |
| 4,819,348 | 4/1989 | DeBolt . |
| 4,819,348 | 4/1989 | DeBolt . |
| 4,864,748 | 9/1989 | Boyer . |
| 4,912,862 | 4/1990 | Bishop et al. . |
| 5,123,186 | 6/1992 | Matushita et al. . |
| 5,148,615 | 9/1992 | Maitlen et al. . |

FOREIGN PATENT DOCUMENTS

| | | |
|---|---|---|
| 275812 | 11/1989 | Japan . |
| 2116605 | 9/1983 | United Kingdom . |

*Primary Examiner*—Randolph A. Reese
*Assistant Examiner*—Spencer Warnick
*Attorney, Agent, or Firm*—Geoffrey A. Mantooth

[57] ABSTRACT

The invention includes a frame, to which is mounted a handle, an engine, drive wheels and an auger. The engine drives the drive wheels, making the apparatus self-propelled and also rotates the auger. Control levers are located on the handle to selectively control the on-off engagement of the drive wheels and the auger to the engine and to control the speed of the drive wheels. As the apparatus propels itself along a trench, the rotating auger moves dirt from the sides of the ground around the trench to inside of the trench. A packer wheel on the handle packs the dirt in the filled trench. The height of the auger relative to the ground is adjustable so as to minimize lawn damage. The auger has a double row of flighting and guide wheels positioned adjacent to the auger to enable the apparatus to be easily steered.

12 Claims, 3 Drawing Sheets

FIG. 2

APPARATUS FOR BACKFILLING

This application is a continuation-in-part of application Ser. No. 07/813,209, filed Dec. 23, 1991 now abandoned.

FIELD OF THE INVENTION

The present invention relates to apparatuses for backfilling or covering up trenches, holes and the like with dirt.

BACKGROUND OF THE INVENTION

In the Southwest United States, the climate is dry, particularly during the summer months. This necessitates frequent irrigation to maintain cultivated plants. This is true even for residential homes with grass lawns. The grass must be irrigated to prevent the grass from drying out.

Irrigation systems for residential homes are commonly referred to as sprinkler systems. A sprinkler system has plural fixed sprinkler heads positioned at various locations around the lawn. The sprinkler heads are interconnected with each other with pipe.

To install a sprinkler system, trenches in the lawn are dug to receive the pipe and the sprinkler heads. The trenches are typically dug with a trenching machine. The machines excavates the soil from the trench and piles it up on top of the lawn on one side of the trench. The pipe is then laid in the trench and connected in an appropriate manner. To complete the installation, the trench is backfilled with the loosened soil. This same procedure is also followed whenever any underground installation such as pipe or cable, is made.

In the prior art there are various machines for backfilling, however, none are suitable for residential use. The prier art machines are too heavy and too large to be practical for residential use. These machines, if used, would cause unsightly rutting in the lawn due to their heaviness. In addition, the heavy prior art machines increase the possibility of breaking pipes and cables already buried beneath the lawn. Should breakage occur, then expensive repair would be required. Furthermore, many residential installations are in fenced backyards. The only access to these backyards is through relatively narrow gateways. The prior art machines are too wide to fit through these gateways. A section of the fence could be removed to accommodate the backfilling machines, but this is usually too expensive and time consuming.

Thus, in the absence of a suitable backfilling machine, the trenches are filled manually with shovels. Laborers move along the trench, shoveling the dirt into the trench. This, however, requires much labor and time. In addition, use of the shovel results in damaging the grass around the trench.

On prior art backfilling machines, the operator rides on the machine during backfilling operations. These machines are relatively easy to steer because their large weight counteracts any lateral forces produced by pushing the dirt into the trench. But, when designing a small backfilling machine for residential lawn use, care must be taken to compensate for the reduced weight of the machine as it relates to steering. A lighter weight machine has a tendency to pull to one side due to the lateral forces produced by pushing the dirt into the trench. This pulling force makes the machine difficult to steer and fatigues the operator.

SUMMARY OF THE INVENTION

It is an object of the present invention to provide a backfilling apparatus that is light enough to be used on residential grass lawns without damaging the lawns.

Another object of the present invention is to provide a backfilling apparatus that is easy to steer and otherwise control.

The apparatus of the present invention includes a frame having front and rear ends and a handle extending from the rear end. The handle allows an operator to maneuver the apparatus as the operator walks behind the apparatus. Engine means provides mechanical power and is coupled to the frame. Drive wheels are rotatably mounted to the frame such that the frame is supported by the drive wheels. The drive wheels are coupled to the engine means such that the drive wheels are rotated by the engine. An auger is also rotatably mounted to the frame. The auger has a shaft with flighting extending therefrom. The shaft is oriented horizontally. The auger has a double row of flighting extending from the shaft. Guide wheels are rotatably coupled to the frame and are located adjacent to ends of the auger. The guide wheels contact the ground beneath the apparatus. The double row of flighting on the auger and the guide wheels allow the apparatus to be easily steered by an operator.

In one aspect of the invention, the apparatus also includes height adjustment means for raising and lowering the auger relative to the ground. The height adjustment means is coupled to the frame and includes height control means for controlling the height setting on the auger. The height control means is coupled to the handle so as to be easily accessible to an operator. In still another aspect of the invention, the height adjustment means includes the guide wheels. The guide wheels are pivotally coupled to the frame such that as the guide wheels change position with respect to the frame, the auger is raised or lowered relative to the ground.

In still another aspect of the present invention, end plates are coupled to the auger ends so as to be coupled to the ends of the flighting. This prevents the sharp edges of the auger from digging into the ground during operation. Thus, the lawn is not damaged by the sharp edges of the auger and the apparatus is easier to steer since the auger does not dig into the lawn.

DESCRIPTION OF THE PREFERRED EMBODIMENT

Figure 1:
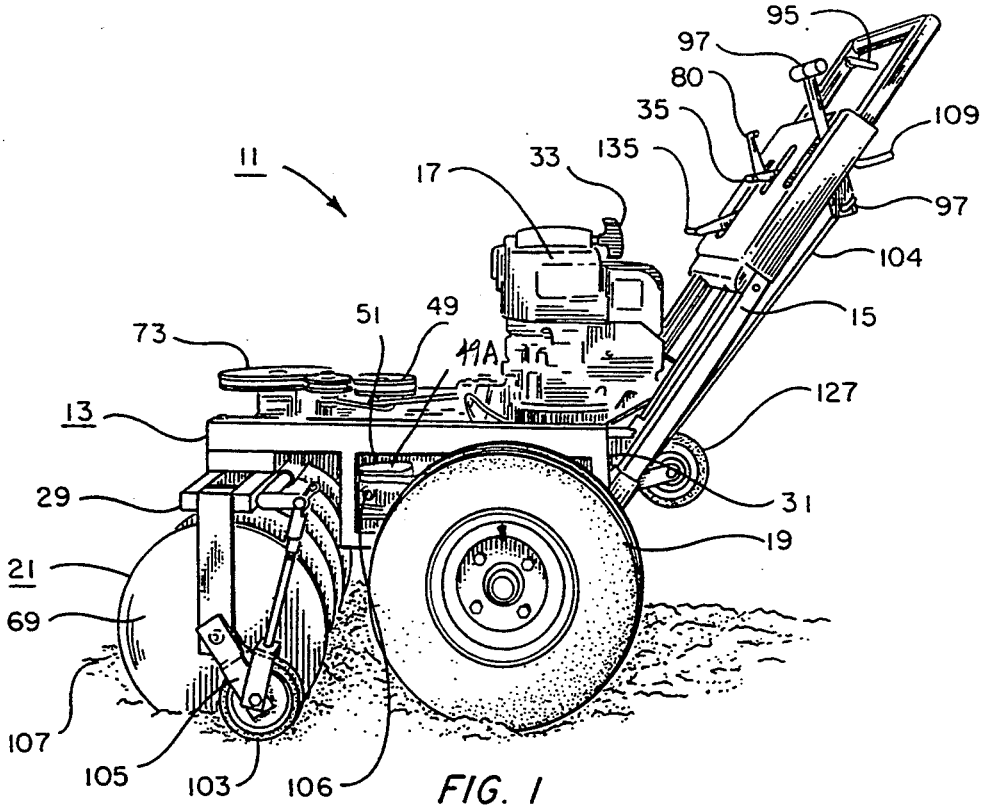
FIG. 1 is a side perspective view of the apparatus of the present invention, in accordance with a preferred embodiment.

In FIG. 1, there is shown a side perspective view of the backfilling apparatus 11 of the present invention, in accordance with a preferred embodiment. The apparatus 11 is designed for backfilling trenches such as those dug during the installation of an irrigation or sprinkler system. The apparatus is self-propelled, so that during backfilling, the apparatus moves along the length of the trench. An operator walks behind the apparatus 11, holding the handle 15 to maneuver the apparatus and to control its various functions.

The apparatus includes a frame 13, a handle 15, an engine 17, drive wheels 19, and an auger 21.

Figure 3:
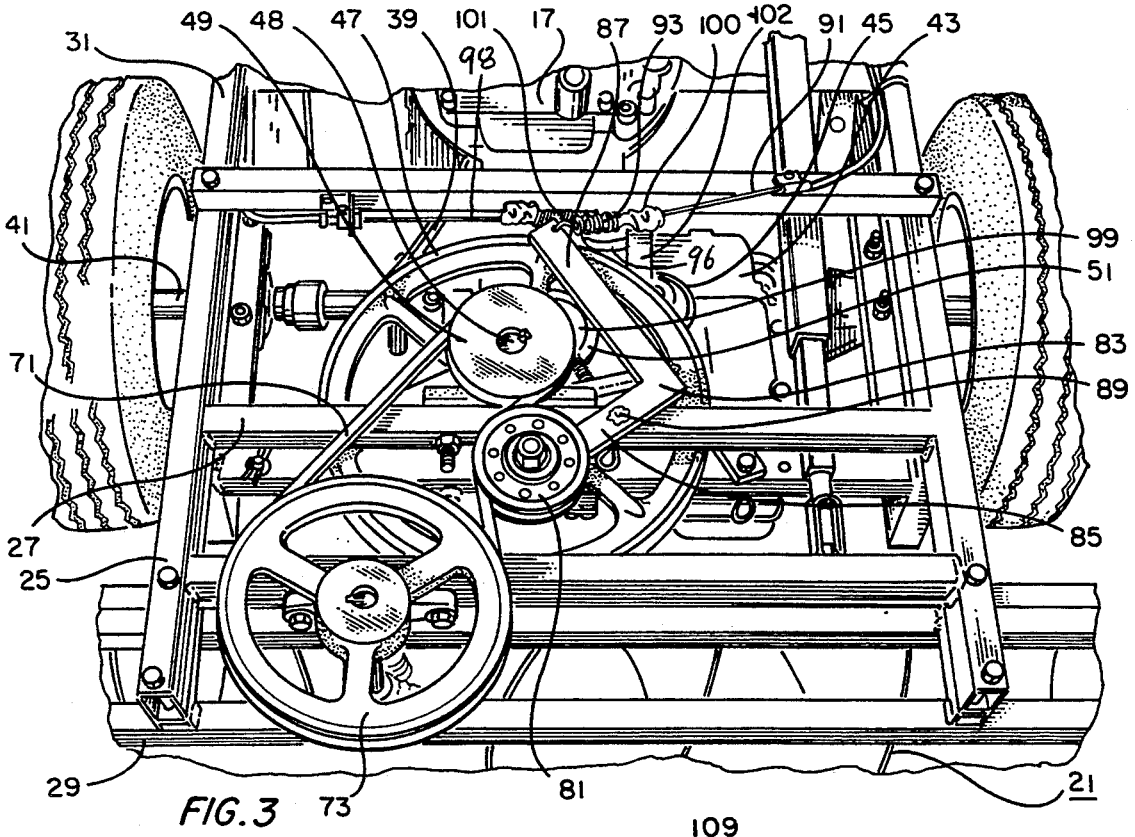
FIG. 3 is a top perspective view, showing the various drive arrangements for the drive wheels and the auger.

Referring to FIGS. 1 and 3, the frame 13 is made up of plural square tubes 25, 27 welded together. There are lateral tubes 25 on the sides of the frame and cross tubes 27 extending across between the lateral tubes. The frame 13 has front and rear ends 29, 31. The handle 15 extends rearwardly and upwardly at an inclined angle from the rear end 31 of the frame. The handle 15 is used by the operator to maneuver the apparatus. In addition, the handle has plural control levers thereon, within easy reach of the operator.

The engine 17 is mounted to the top of the frame 13. The engine 17 is a conventional gasoline powered engine. A pull cord 33 is provided to start the engine. The speed of the engine is controlled by its throttle. The throttle in turn is controlled by a throttle lever 35 on the handle 15, that is connected to the throttle by a cable 37 (see FIG. 5). A drive shaft (not shown) extends from the bottom of the engine. A sheave is mounted on the drive shaft. The sheave receives a drive belt 39.

The drive wheels 19 are rubber tires that are rotatably mounted to the frame 13. The wheels are mounted on an axle 41, which in turn is mounted to the frame 13 by way of bearings (see FIG. 3).

The wheels 19 are rotated by the engine 17 through a conventional transmission 43. The transmission 43 allows the speed that the apparatus propels itself over the ground to be adjusted. The drive wheel axle 41 is connected to the output of the transmission 43. The input of the transmission 43 has an input sheave 45. The input sheave 45 is connected to the engine 17 as follows: the drive belt 39 is coupled to a rotatable output shaft of the engine, preferably by looping the belt 39 around a sheave that is coupled to the engine output shaft. The drive belt 39 from the engine rotates a large diameter drive sheave 47. Two take off sheaves are coupled to a shaft 48 that is in turn coupled to the drive sheave, such that the take-off sheaves are rotated in unison with the drive sheave. There is an upper take-off sheave 49 that is located above the drive sheave 47 and is used to rotate the auger 21. There is also a lower take-off sheave 49A that is located below the drive sheave 47 and that drives the transmission. The upper and lower take-off sheaves 49, 49A are substantially similar to each other with the possible exception of their diameters. A transmission belt 51 couples the lower take-off sheave 49A to the input sheave 45 of the transmission 43.

Figure 2:
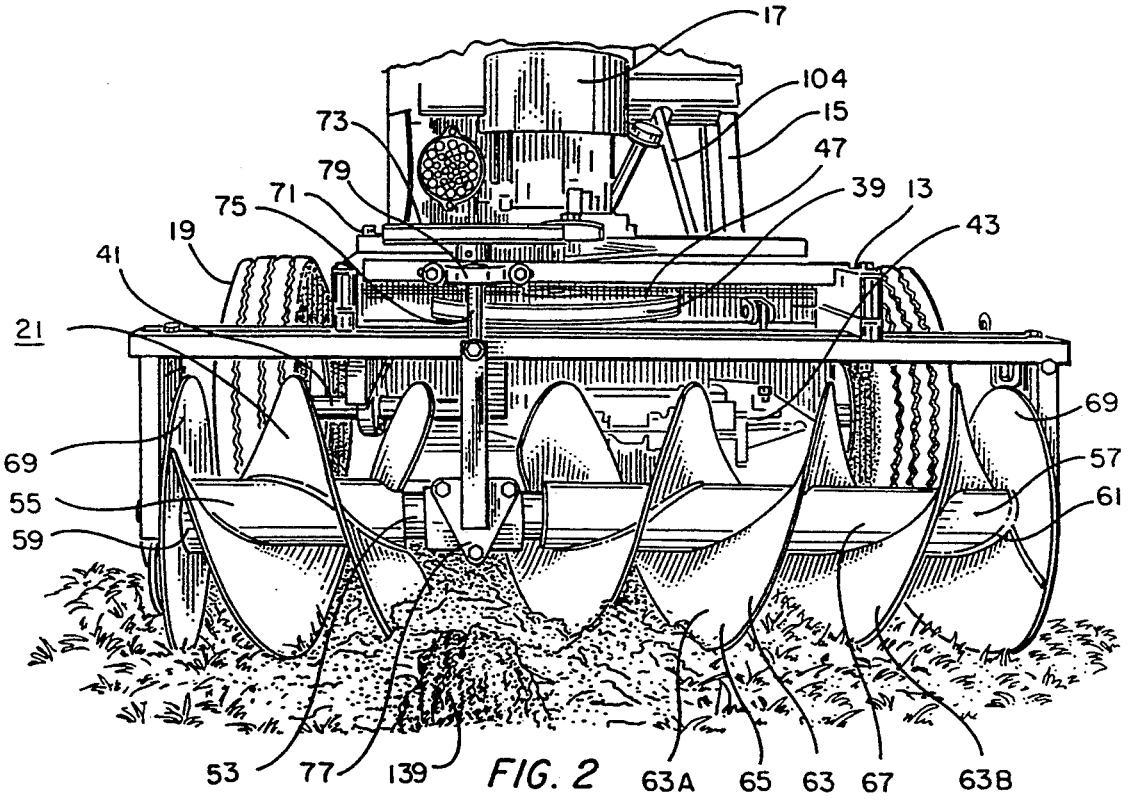
FIG. 2 is a front perspective view of the apparatus.

Referring to FIG. 2, the auger 21 extends across the front end 29 of the frame. The ends of the auger are rotatably coupled to the frame. The auger 21 is oriented in a horizontal direction, with its longitudinal axis parallel to the drive wheel axle 41. The auger 21, which is rotated from a center portion 53, has first and second portions 55, 57. The first portion 55 extends from a first end 59 to the center portion 53, while the second portion 57 extends from a second end 61 to the center portion. In the preferred embodiment, the second portion 57 is longer than the first portion 55 because many types of trenching machines throw the dirt primarily on one side of the trench when digging. The second portion is located on this particular side of the trench. Each auger portion has flighting 63 for moving dirt from the ends to the center. Each row of flighting is formed by a vane 65 that extends radially outward from the shaft 67. The vane 65 spirals around the circumference of the shaft from the end to the center portion. Each auger portion has two rows 63A, 63B of flighting, with the rows being separated by 180 degrees on the shaft. This double row of flighting allows the auger to maintain the desired pitch, while allowing more dirt to be moved. There is an end plate 69 at the end of each of the first and second ends. The ends of the flighting 63 are welded to the circular end plates 69. Thus, the end plates 69 rotate in unison with the flighting 63. The flighting on the first auger portion 55 is oriented in the opposite direction from the flighting on the second auger portion 57. All of the flighting is oriented so that as the auger is rotated with the bottom portion moving forward, dirt is moved from the ends to the center. The auger 21 is rotated with the bottom portion moving forward so as to sweep the dirt out in front of the apparatus. This assists in breaking up clods of dirt.

Referring to FIGS. 2 and 3, the auger 21 is rotated by the engine 17. An auger belt 71 couples the upper take off sheave 49 to an auger sheave 73, which is mounted on top of and at the front end 29 of the frame 13. As the auger sheave 73 rotates, it rotates a vertical shaft 75 that extends into a conventional T-coupling 77. The vertical shaft 75 is coupled to the frame by way of a bearing 79. The vertical shaft 75 rotates the auger 21 by way of the T-coupling 77.

An auger control lever 80 (see FIG. 1) is provided on the handle 15 for starting and stopping the rotation of the auger. This allows the engine 17 to be operated continuously, while selectively operating the auger 21. The auger belt 71 is ordinarily loose on the upper take-off sheave 49 and on the auger sheave 73 so that as the engine rotates the drive and take-off sheaves 47, 49, 49A and the auger sheave 73 will not rotate. This is because the auger belt 71 slips through the auger sheave 73. An idler sheave 81 is provided to selectively increase the auger belt 71 tension. The idler sheave 81 is pivotally coupled to the frame 13 by a bracket 83. The bracket 83 has two arms 85, 87 that are perpendicularly oriented to each other. One arm 85 supports the idler sheave 81, with the idler sheave being rotatable thereon. This arm 85 is coupled to the frame by a pin, which forms a pivot point 89 for the bracket 83. The other arm 87 is connected to the auger control lever 80 on the handle by way of a cable 91.

As the auger control lever 80 is pushed down, the cable 91 (see FIG. 3) tightens and pulls the bracket arm 87 away from sheave 49. This forces the idler sheave 81 into the auger belt 71, wherein the auger belt 71 tightens and causes the engine 17 to rotate the auger 21. As the auger control lever 80 is pulled back up, the cable 91 loosens, allowing the bracket arm 87 to move back toward the sheave 49. The force responsible for moving the bracket 83 and the sheave 81 away from the auger belt 71 is the tension of the auger belt itself. The tight auger belt 71 pushes the idler sheave 81 away, causing the bracket 83 to pivot. Thus, the auger belt 71 becomes loose, wherein rotation of the auger stops.

The cable 91 is coupled to the bracket arm 87 by way of a stiff spring 93. The spring 93 allows for wear on the belt 71. The travel of the auger control lever 80 is greater than the movement of the sheave 81 between its slack and tension (relative to the belt 71) positions. Thus, as the auger control lever 80 is pushed down, at some intermediate point in its downward travel, the sheave 81 will fully engage the belt 71, causing the auger to rotate. Continued downward movement of the lever 80 causes the spring 93 to stretch. The spring 93 is coupled to the cable 91 at connection point 100.

There are provided on the handle 15 two control levers for controlling the operation of the drive wheels (see FIG. 1). The first control lever 95 controls the on-off operation of the drive wheels, while the second control lever 97 controls the speed of the drive wheels.

The on-off control lever 95 operates by controlling the tension of the engine drive belt 39 in the same way that the tension of the auger belt 71 is controlled. The drive belt 39 is ordinarily loose so that as the engine 17 rotates, the drive sheave 47 will not rotate because the belt 39 slips through the drive sheave. An idler sheave 96, which is substantially similar to the auger idler sheave 81, selectively tightens and loosens the drive belt 39. The idler sheave 96 is coupled to a bracket 102, which in turn is pivotally coupled to the frame 13. A cable 98 couples the on-off lever 95 on the handle 15 to the bracket 102. When the lever 95 is pulled, the cable 98 is pulled tight and the idler sheave 96 is pulled into the drive belt 39, thereby tensioning the belt. Thus, the wheels 17 and auger 21 can rotate. When the lever is released, the cable 98 slackens. The tension of the drive belt 39 pushes the idler sheave 96 away, thereby slackening the drive belt. The wheels and auger stop rotating.

The end of the cable 98 is coupled to the bracket 102 by a spring 101. This allows for wear in the drive belt in a manner similar to the auger spring 93.

Idler sheave 99 is provided to tension transmission belt 51. A spring pulls the sheave 99 into the belt 51.

The speed control lever 97 is also located on the handle 15 (see FIG. 1). The speed control lever 97 controls the speed ratio of the transmission 43. The lever 97 is coupled to the transmission 43 by way of a rod 104 and a clevis pin 106. As the speed control lever 97 is moved up and down, the transmission 43 is shifted into its various speeds, thus allowing the apparatus to be driven at slow, fast and intermediate speeds.

Figure 4:
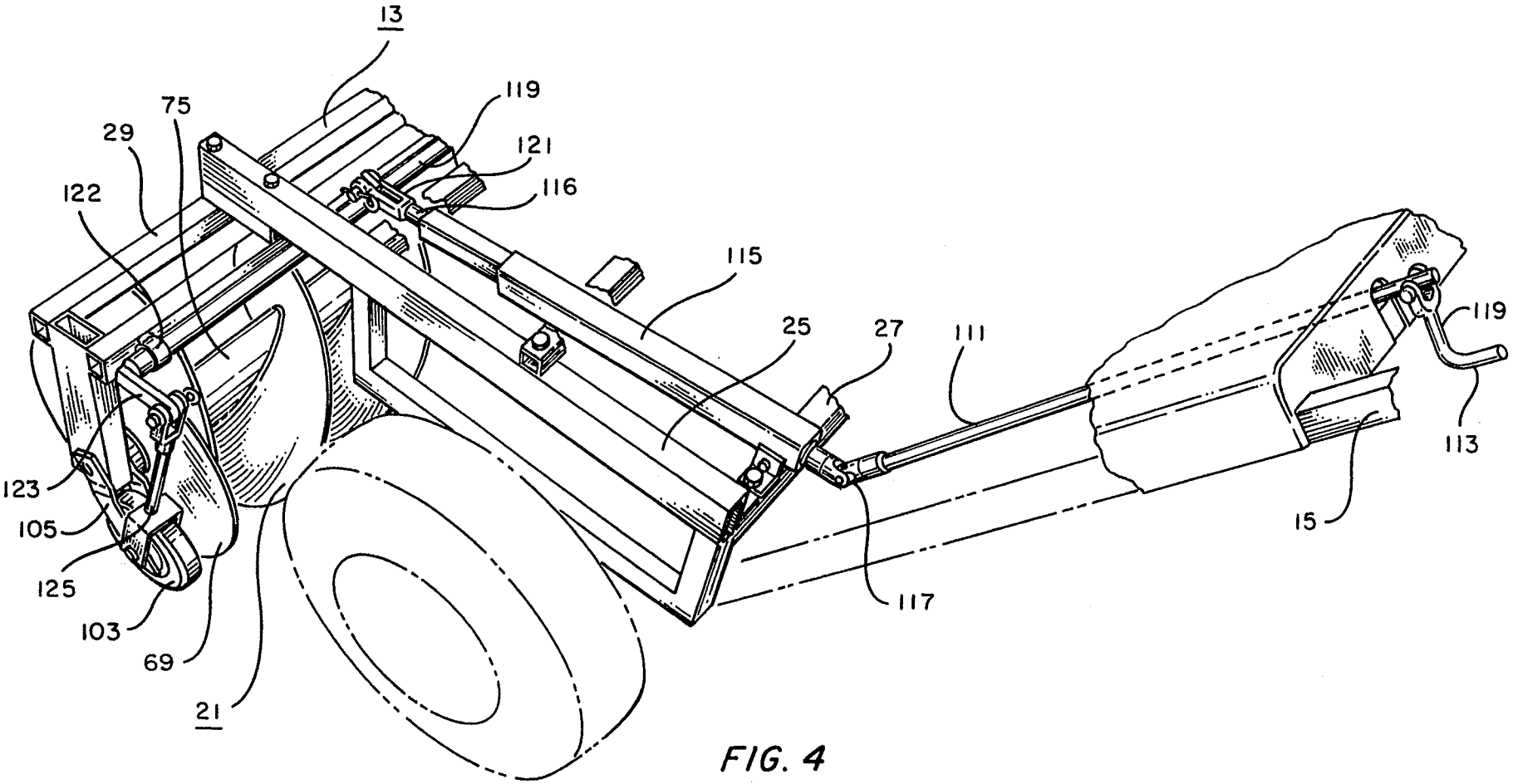
FIG. 4 is a perspective view showing the auger depth adjustment means.

Referring to FIGS. 1 and 4, there are also provided guide wheels 103 located on the outermost ends of the auger 21. Each guide wheel 103 is pivotally coupled to the frame 13 by way of arms 105. The arms 105 allow the guide wheels 103 to rotate on the ground. The arms 105 themselves are pivotally coupled to the frame 13. Pivoting the guide wheels with respect to the frame allows the height of the auger 21 relative to the ground 107 to be adjusted.

The position of the guide wheels 103 relative to the frame 13 is controlled by a crank 109 located on the handle 15. The crank 109 is made up of a rod 111 and a handle 113. The rod 111 extends downwardly where it is connected to the input of a screw assembly 115 by way of a U-joint 117. The screw assembly 115 is coupled to the frame. The output 116 of the screw assembly is connected to a shaft 119 by way of a clevis pin 121. The shaft 119, which is parallel to the shaft 75 of the auger, is rotatably coupled to the frame 13 by sleeves 122. At each end of the shaft 119 is an arm 123 that extends perpendicularly out from the shaft. The free end of each arm 123 is connected to a guide wheel 103 by a rod 125. The rod 125 has a clevis on each end to respectively pivotally couple to the arm 123 and to the guide wheel 103. The guide wheel 103 is rotatable within the rod clevis.

To adjust the position of the guide wheels 103, the crank 109 is rotated. This causes the screw output 116 to either push out or pull in, which in turn causes the shaft 119 to rotate. As the shaft 119 rotates, the end arms 123 are either raised or lowered, correspondingly raising or lowering the guide wheels 103. Rotating the crank 109 in one direction raises the guide wheels 103 with respect to the frame 113, wherein the auger 21 is lowered to the ground 107. Rotating the crank 109 in the opposite direction lowers the guide wheels 103 with respect to the frame 13, wherein the auger is raised off of the ground.

Figure 5:
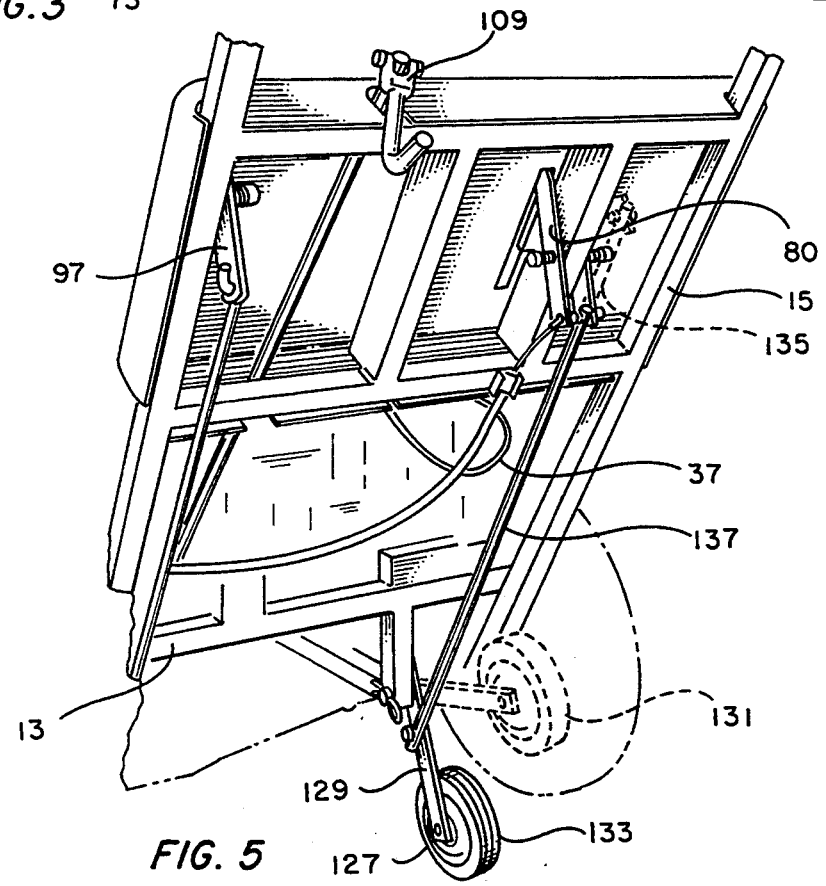
FIG. 5 is a rear perspective view showing the handle assembly and the packer wheel.

The apparatus 11 is also provided with a packer wheel 127 to pack the dirt in the filled in trench. Referring to FIG. 5, the packer wheel 127 is pivotally coupled to the frame 13 by way of an arm 129. The packer wheel 127 is rotatably coupled to the arm. The packer wheel is retractable to an up position 131, from a down position 133. A packer lever 135 is provided on the handle to adjust the packer wheel position. The lever 135 is coupled to the arm 129 by way of a linkage rod 137. The respective ends of the rod 137 are pivotally coupled to the lever 135 and to the arm 129.

In the preferred embodiment, the packer wheel 127 is narrower than the width of the trench. This enables the packer wheel to apply more pounds per square inch of pressure than with a wider wheel. The packer wheel 102 mashes part of the air out of the trench to compact the dirt. A wider wheel would not be able to apply the desired pressure because of the larger area and the fixed light weight of the apparatus.

The operation and use of the apparatus 11 of the preferred embodiment will now be described. The apparatus 11 is used to move dirt from a location on the ground beside a trench to inside of the trench. The apparatus is self-propelled, wherein an operator walks behind holding the handle 15 to steer and control the apparatus.

The first step in using the apparatus 11 is to start the engine 17 by pulling on the starter cord 33. Once started, the engine speed is adjusted with the throttle lever 35. Typically, the engine is operated at full speed. Next, the drive lever 95 is actuated to engage the drive wheels 19. Once the drive wheels are engaged, the apparatus 11 propels itself in a forward direction. The operator steers the apparatus to the work site. The speed of propulsion can be adjusted by actuating the transmission lever 97.

When the apparatus 11 reaches the trench 139 to be filled in, it is oriented so that the auger 21 is perpendicular to the trench. The second or longer portion 57 is located on the side of the trench having the most dirt and the drive mechanism 77 of the auger is located over the trench. The packer wheel 127 is lowered to the down position 133 by the packer lever 135. Then, the auger lever 80 is actuated so as to allow rotation of the auger 21. Then, the drive lever 95 is actuated, causing the drive wheels 19 to move the apparatus forward and causing the auger 71 to be rotated.

As the apparatus moves forward along the length of the trench, the auger moves the dirt from the grass on the sides of the trench to the inside of the trench. The auger rotates so that its bottom portion sweeps forward (this is clockwise with respect to the orientation of FIG. 1). The direction of auger rotation assists in breaking up clods of dirt by sweeping them in front of the apparatus, where the auger can again be brought into contact with the clods.

The forward speed of the apparatus can be adjusted with the lever 97. The speed of the apparatus will depend on the type and amount of dirt to be moved and the skill of the operator. For example, a deep trench will have a large amount of dirt to be moved, thus requiring a slower forward speed.

The packer wheel 127, which is located behind the auger 21, packs the dirt down inside the trench.

The apparatus 11 is small enough to be used in almost any lawn situation. In the preferred embodiment, the apparatus is 44 inches in width. This allows the apparatus to fit through standard 4 foot gateways in fences so as to be used in back yards. The narrow width is achieved by driving the auger from a center position instead of from one of the auger ends. As shown by FIG. 2, the drive mechanism 77 is positioned over the trench. The portion of the auger that is located over the trench is not used to convey dirt. The apparatus 11 takes advantage of this unused auger portion and uses it to rotate the auger.

The apparatus 11 of the present invention is able to back fill trenches without damaging the grass lawn. The operator walks behind the apparatus instead of riding on top. This, plus the small size, results in a lighter apparatus that is easier on the lawn. The double row of flighting 63 enables the auger 21 to move dirt with a minimum amount of dragging of the dirt, which can damage the grass.

Lawn damage is further minimized by adjusting the depth of the auger 21 in the grass with the guide wheels 103. Some grasses tolerate a lower auger setting than other grasses. In addition, the auger can make a cleaner sweep of the dirt from the lawn. Some grasses are coarser, requiring a lower auger setting to sweep out dirt that has fallen between the grass blades. Also, the end plates 69 of the auger serve to close off the auger ends. This prevents dirt from spilling to the outside of the auger.

The end plates 69 close off the sharp end edges of the auger 21. Thus, the sharp edges are prevented from catching the ground and digging in. This results in making the apparatus easier to operate and saves the lawn from being divoted.

The apparatus of the present invention is easy to operate. Even though the apparatus is relatively light in weight, it propels itself in a straight direction when backfilling. This is because the double row of flighting on the auger reduces side drag. Side drag is caused by the auger forcing the dirt laterally toward the trench. To react to the auger pushing the dirt, a light machine tends to turn away from the trench. This makes steering difficult and tiresome. But, with the double row of flighting on the apparatus 11, side drag is minimized, making the apparatus easier to steer and control. In addition, the guide wheels 103, which are located adjacent to the ends of the auger, assist in maintaining the apparatus in a straight direction.

The drive wheels also serve to make the apparatus easy to operate. The drive wheels 19 are separated by a width that is as long as the auger. This gives the apparatus stability during operation. For example, during backfilling, one end of the auger could be raised by a large mound of dirt or by the unevenness of the lawn. With the drive wheels spaced apart, the apparatus is less likely to turn over.

The foregoing disclosure and the showings made in the drawings are merely illustrative of the principles of the invention and are not to be interpreted in a limiting sense.

I claim:

1. An apparatus for use in backfilling, comprising:

a) a frame having front and rear ends, said frame having a handle extending from said rear end, said handle allowing an operator to maneuver said apparatus as said operator walks behind said apparatus;

b) engine means for providing mechanical power, said engine means being mounted onto said frame;

c) drive wheels rotatably mounted to said frame such that said frame is supported by said drive wheels, said drive wheels being coupled to said engine means such that said drive wheels are rotated by said engine;

d) an auger rotatably mounted to said frame, said auger having a shaft with a double row of solid wall flighting extending radially outward therefrom, said shaft being oriented horizontally, said auger and said flighting having respective ends, said auger being for filling a trench with dirt;

e) guide wheels rotatably mounted to said frame, said guide wheels being located adjacent to ends of said auger, said guide wheels contacting the ground beneath said apparatus to allow said apparatus to be easily steered by said operator with the handle;

f) end plates coupled to the ends of said flighting at said ends of said auger to close off the ends of the auger to prevent dirt from spilling to the outside of the auger.

2. The apparatus of claim 1 further comprising height adjustment means for raising and lowering said auger relative to said ground, said height adjustment means being coupled to said frame, said height adjustment means comprising height control means for controlling the height setting of said auger, said height control means being coupled to said handle so as to be easily accessible to an operator.

3. The apparatus of claim 2 wherein said height adjustment means comprises guide wheel coupling means for pivotally coupling said guide wheels to said frame such that as said guide wheels change position with respect to said frame, said auger is raised or lowered relative to the ground.

4. The apparatus of claim 1, further comprising:

a) height adjustment means for raising and lowering said auger relative to said ground, said height adjustment means being coupled to said frame, said height adjustment means comprising height control means for controlling the height setting of said auger, said height control means being coupled to said handle so as to be easily accessible to an operator;

b) said height adjustment means comprises guide wheel coupling means for pivotally coupling said guide wheels to said frame such that as said guide wheels change position with respect to said frame, said auger is raised or lowered relative to the ground;

c) packer means for packing dirt in a trench after said auger has filled said trench, said packer means being coupled to said handle.

5. The apparatus of claim 1 wherein said auger has a center portion, a first portion located between one of said ends of said auger and said center portion, and a second portion located between the other of said ends of said auger and said center portion, said auger being rotated by said engine means at said center portion.

6. The apparatus of claim 1 wherein said auger is driven so as to sweep dirt out in front of the apparatus in addition to moving dirt along the direction of said auger shaft.

7. The apparatus of claim 1 further comprising:

f) packer means for packing said dirt in said trench after said auger has filled said trench, said packer means being coupled to said handle.

8. An apparatus for use in backfilling a trench, comprising:

a) a frame having front and rear ends, said frame having a handle extending from said rear end, said handle allowing an operator to maneuver said apparatus as said operator walks behind said apparatus;

b) engine means for providing mechanical power, said engine means mounted onto said frame, said engine means having throttle control means for controlling the power of said engine means, said throttle control means being located on said handle;

c) drive wheels rotatably mounted to said frame such that said drive wheels support said frame above the ground, said drive wheels being coupled to said engine means such that said drive wheels are rotated by said engine;

d) an auger rotatably mounted to said frame, said auger being oriented so as to be horizontal and so as to extend across the front end of said frame, said auger having a shaft with first and second ends and a center portion, said auger having a first double row of solid wall flighting extending from said first end to said center portion and an oppositely directed second double row of solid wall flighting extending from said second end to said center portion said first and second double rows of flighting extending radially outward from said shaft, said auger being mounted to said frame by said first and second ends, said auger being for filling said trench with dirt;

e) end plates coupled to said first and second ends of said auger to close off the ends of the auger to prevent dirt from spilling to the outside of the auger, said auger having a length between said first and second ends, said drive wheels being separated by a distance that is as long as the length of said auger;

f) said auger being coupled to said engine means at said center portion such that said engine means rotates said auger.

9. The apparatus of claim 8 further comprising packer means for packing dirt in said trench after said auger has filled said trench, said packer means being coupled to said handle.

10. The apparatus of claim 9 wherein said packer means comprises a packer wheel, said packer wheel being movable between up and down positions, wherein when said packer wheel is in said down position, said packer wheel packs said dirt.

11. The apparatus of claim 8 further comprising transmission means and drive wheel speed control means for controlling the speed of said drive wheels, said transmission means being mounted to said frame and having an input connected to said engine and an output connected with said drive wheels, said drive wheel speed control means being coupled to said handle and controlling an output ratio of said transmission.

12. The apparatus of claim 7 wherein said second row of flighting of said auger is longer than said first row of flighting.

* * * * *